US012006655B2

(12) United States Patent
Velde et al.

(10) Patent No.: US 12,006,655 B2
(45) Date of Patent: Jun. 11, 2024

(54) GROUND ENGAGING TOOL CONTACT DETECTION SYSTEM AND METHOD

(71) Applicant: Deere & Company, Moline, IL (US)

(72) Inventors: Todd F. Velde, Dubuque, IA (US); Leonardo M. Messias, Dubuque, IA (US); Craig Christofferson, Dubuque, IA (US)

(73) Assignee: Deere & Company, Moline, IL (US)

( * ) Notice: Subject to any disclaimer, the term of this patent is extended or adjusted under 35 U.S.C. 154(b) by 403 days.

(21) Appl. No.: 17/444,213

(22) Filed: Aug. 2, 2021

(65) Prior Publication Data

US 2023/0030029 A1 Feb. 2, 2023

(51) Int. Cl.
*E02F 3/84* (2006.01)

(52) U.S. Cl.
CPC ..... *E02F 3/842* (2013.01); *E02F 3/847* (2013.01)

(58) Field of Classification Search
CPC ..... E02F 3/842; E02F 3/847
USPC ..... 701/50
See application file for complete search history.

(56) References Cited

U.S. PATENT DOCUMENTS

| | | | | |
|---|---|---|---|---|
| 10,186,004 | B2 * | 1/2019 | Wei | G06Q 10/06398 |
| 11,691,648 | B2 * | 7/2023 | Theverapperuma | G06V 10/82 701/25 |
| 2015/0225923 | A1 | 8/2015 | Wallace et al. | |
| 2018/0094408 | A1 * | 4/2018 | Shintani | E02F 9/26 |
| 2018/0174291 | A1 | 6/2018 | Asada et al. | |
| 2018/0251961 | A1 * | 9/2018 | France | B60R 1/00 |
| 2020/0131731 | A1 * | 4/2020 | Wu | E02F 9/2041 |
| 2020/0387720 | A1 * | 12/2020 | Stanhope | A01B 79/02 |
| 2021/0047808 | A1 * | 2/2021 | Yamada | E02F 9/268 |
| 2021/0381194 | A1 * | 12/2021 | Kennedy | E02F 9/0841 |
| 2022/0024485 | A1 * | 1/2022 | Theverapperuma | G06V 10/77 |
| 2022/0074168 | A1 * | 3/2022 | Yamada | E02F 3/435 |
| 2022/0186461 | A1 * | 6/2022 | Konda | E02F 9/24 |

(Continued)

FOREIGN PATENT DOCUMENTS

| | | | | |
|---|---|---|---|---|
| AU | 2017202070 | A1 * | 11/2017 | B60N 2/79 |
| DE | 112018001587 | T5 | 12/2019 | |

(Continued)

OTHER PUBLICATIONS

German Search Report issued in application No. DE102022206155.1 dated Mar. 10, 2023 (08 pages).

*Primary Examiner* — Tuan C To

(57) ABSTRACT

A work vehicle that operates on a surface comprising an implement and an optical sensor. The optical sensor is configured to capture image data that includes the implement. An electronic processor is configured to perform an operation by controllably adjusting a position of the implement relative to the work vehicle, receive image data captured by the optical sensor, apply an artificial neural network to identify whether the implement is in contact with the surface based on the image data from the optical sensor, wherein the artificial neural network is trained to receive the image data as input and to produce as the output an indication of whether the implement is in contact with the surface, access operation information corresponding to whether the implement is in contact with the surface from a non-transitory computer-readable memory, and automatically adjust an operation of the work vehicle based on the accessed operation information.

20 Claims, 4 Drawing Sheets

(56) References Cited

U.S. PATENT DOCUMENTS

| | | | | |
|---|---|---|---|---|
| 2022/0220694 | A1* | 7/2022 | Suzuki | E02F 3/32 |
| 2022/0301142 | A1* | 9/2022 | Henry | A01B 79/005 |
| 2022/0381007 | A1* | 12/2022 | Hodel | E02F 9/2054 |
| 2022/0382251 | A1* | 12/2022 | Hodel | E02F 9/205 |

FOREIGN PATENT DOCUMENTS

| | | | | |
|---|---|---|---|---|
| DE | 102019211801 | A1 | 2/2020 | |
| DE | 102021204424 | A1 | 9/2021 | |
| DE | 102021204797 | A1 | 11/2022 | |
| EP | 1862050 | B1 | 6/2009 | |
| EP | 3168373 | A1 | 5/2017 | |
| EP | 3985183 | A1 | 4/2022 | |
| WO | WO-2015187467 | A1 * | 12/2015 | A01B 69/004 |

* cited by examiner

GROUND ENGAGING TOOL CONTACT DETECTION SYSTEM AND METHOD

FIELD OF THE DISCLOSURE

The present disclosure relates generally to ground engaging tool contact detection systems, and more particularly to a ground engaging tool contact detection system and method for a crawler.

BACKGROUND OF THE DISCLOSURE

Work vehicles, such as a crawler or motor grader, can be used in construction and maintenance for grading terrain to a flat surface at various angles, slopes, and elevations. When paving a road for instance, a motor grader can be used to prepare a base foundation to create a wide flat surface to support a layer of asphalt. When automatically controlling a ground engaging tool, it is valuable to know when the tool is in contact with a surface. As such, there is a need in the art for an improved system and method that identifies when the ground engaging tool is in contact with the surface.

SUMMARY OF THE DISCLOSURE

According to one embodiment of the present disclosure, a control system for a work vehicle that operates on a surface is disclosed. The control system comprises an optical sensor that is coupled to the work vehicle. The optical sensor is configured to capture image data that includes an implement. A non-transitory computer-readable memory stores operation information. An electronic processor is configured to perform an operation by controllably adjusting a position of the implement relative to the work vehicle. The electronic processor receives image data captured by the optical sensor and applies an artificial neural network to identify whether the implement is in contact with the surface based on the image data from the optical sensor. Wherein, the artificial neural network is trained to receive the image data as an input and to produce as an output an indication of whether the implement is in contact with the surface. The electronic processor accesses, from the non-transitory computer-readable memory, the operation information corresponding to whether the implement is in contact with the surface, and automatically adjusts an operation of the work vehicle based on the accessed operation information corresponding to whether the implement is in contact with the surface.

According to another embodiment of the present disclosure, a work vehicle that operates on a surface is disclosed. The work vehicle comprises an implement and an optical sensor. The optical sensor is coupled to the work vehicle. The optical sensor is configured to capture image data that includes the implement. A non-transitory computer-readable memory is provided for storing operation information. An electronic processor is provided and is configured to perform an operation by controllably adjusting a position of the implement relative to the work vehicle, receive image data captured by the optical sensor, apply an artificial neural network to identify whether the implement is in contact with the surface based on the image data from the optical sensor, wherein the artificial neural network is trained to receive the image data as input and to produce as the output an indication of whether the implement is in contact with the surface, access, from the non-transitory computer-readable memory, the operation information corresponding to whether the implement is in contact with the surface, and automatically adjust an operation of the work vehicle based on the accessed operation information corresponding to whether the implement is in contact with the surface.

According to another embodiment of the present disclosure a method is disclosed. The method includes capturing image data with an optical sensor coupled to the work vehicle wherein, the image data includes an implement. The method further includes identifying whether the implement is in contact with the surface by processing the image data with an electronic processor. The method includes accessing, from a non-transitory computer-readable memory, operation information corresponding to whether the implement is in contact with the surface and automatically adjusting an operation of the work vehicle based on the accessed operation information corresponding to whether the implement is in contact with the surface.

Other features and aspects will become apparent by consideration of the detailed description and accompanying drawings.

BRIEF DESCRIPTION OF THE DRAWINGS

The detailed description of the drawings refers to the accompanying figures in which.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

DETAILED DESCRIPTION OF THE DRAWINGS

Figure 1:
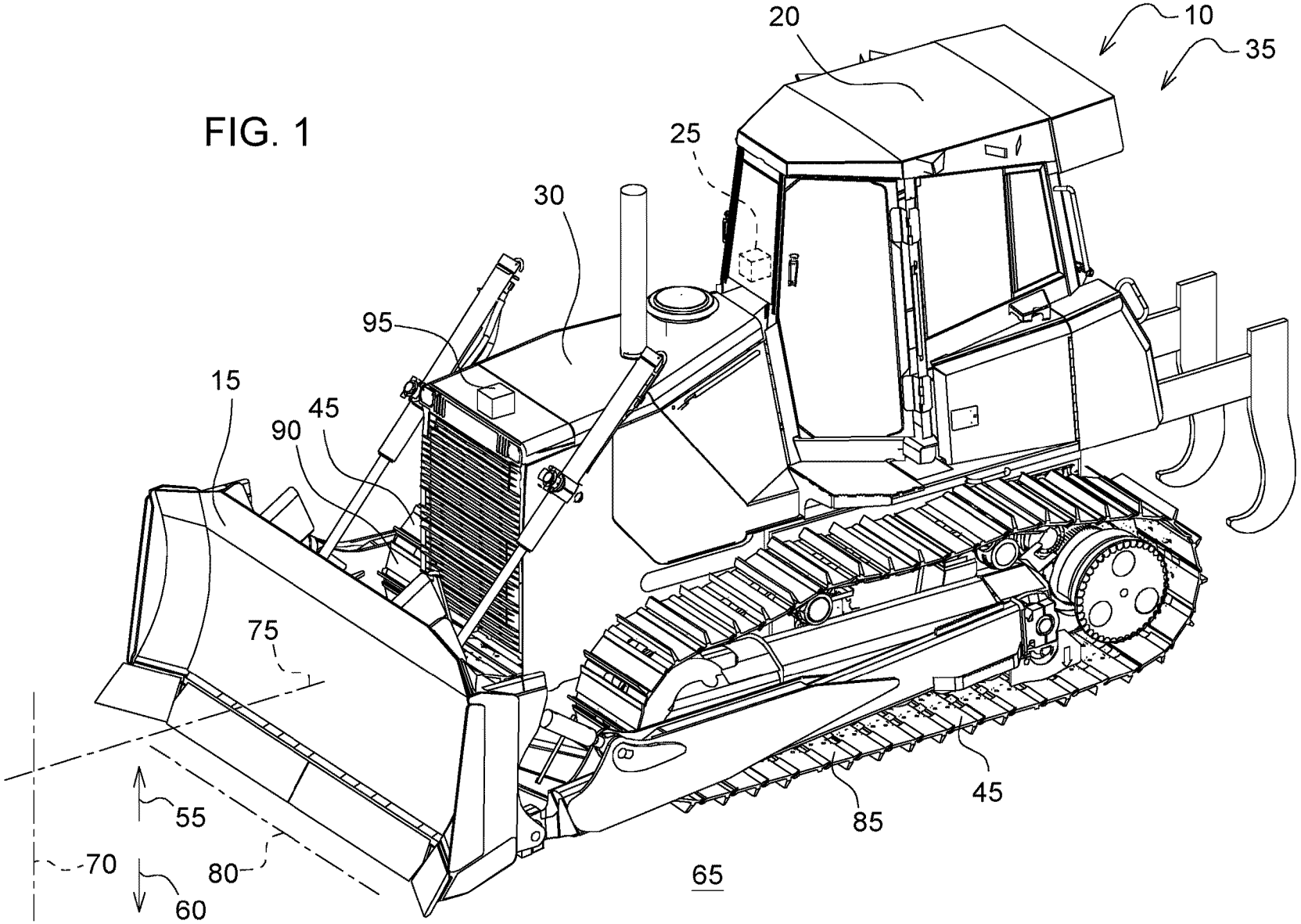
FIG. 1 is a perspective view of a work vehicle according to an embodiment.
Figure 2:
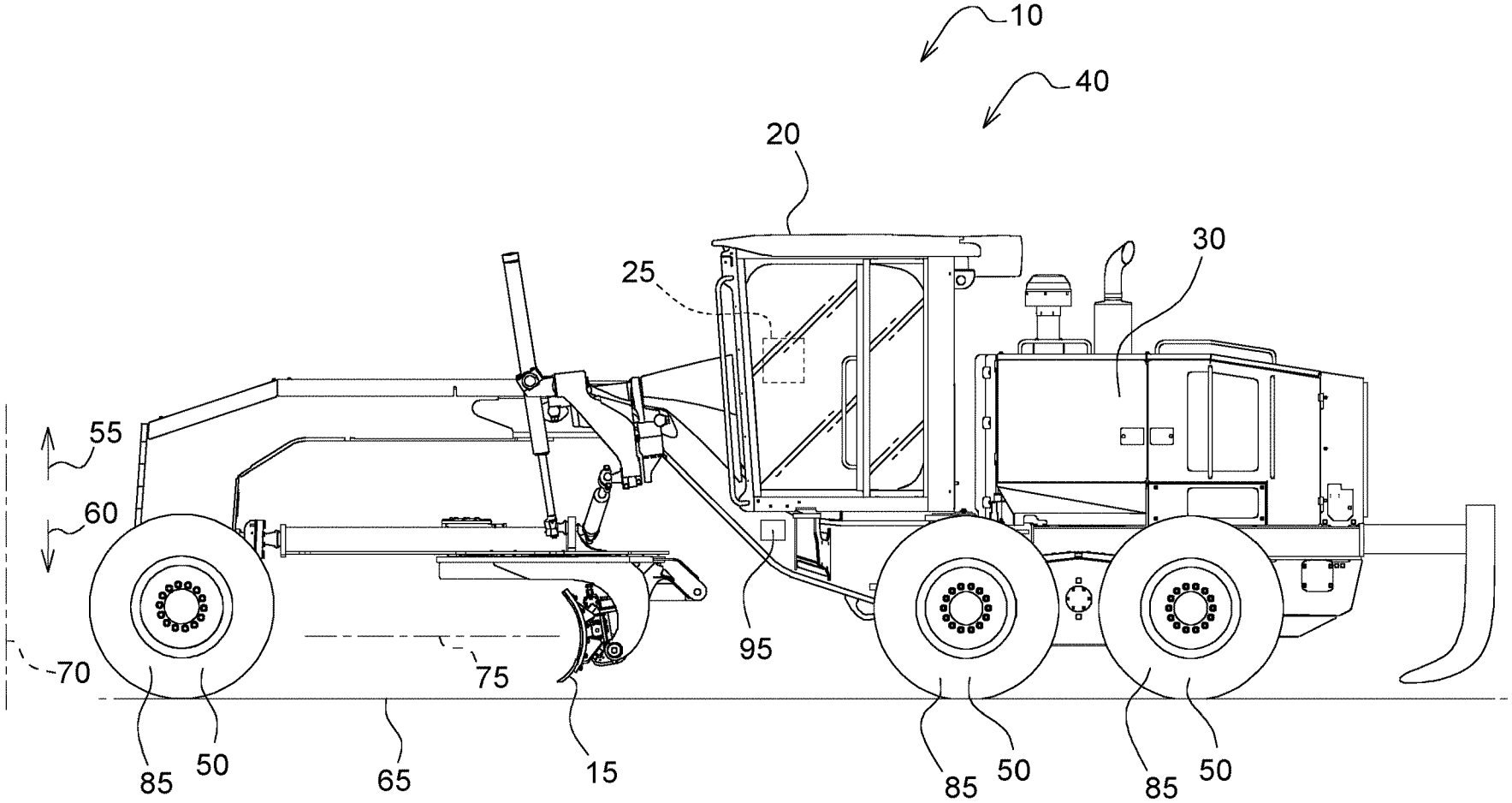
FIG. 2 is a side view of a work vehicle according to another embodiment.

FIGS. 1 and 2 illustrate a work vehicle 10 having an implement 15, an operator station 20 having an operator interface 25, and an engine 30. The work vehicle 10 may be any work vehicle 10 to which the implement 15 may be coupled, such as a crawler 35 or a motor grader 40, to name a few examples. The work vehicle 10 may be controlled by an operator located in the operator station 20 or by an operator located remote from the work vehicle 10. The operator may command the work vehicle 10 to move forward, move backward, and turn. Those commands are sent to hydraulic pumps, driven by the engine 30, which direct pressurized hydraulic fluid to hydraulic motors that turn tracks 45 or wheels 50. The engine 30 may be a diesel engine. Alternatively, the tracks 45 or wheels 50 may be turned by electric motors.

The implement 15 may be positioned at a front of the work vehicle 10 and may be attached to the work vehicle 10 in a number of different manners. In this embodiment, the implement 15 is attached to the work vehicle 10 through a linkage which includes a series of pinned joints, structural members, and hydraulic cylinders. This configuration allows the implement 15 to be moved up 55 and down 60 relative to a surface 65 or ground, rotate around a vertical axis 70

(i.e., an axis normal to the ground), rotate around a longitudinal axis 75 (e.g., a fore-aft axis of the work vehicle 10), and rotate around a lateral axis 80 of the work vehicle 10 (i.e., a left-right axis of the work vehicle 10). These degrees of freedom permit the implement 15 to engage the ground at multiple depths and cutting angles. Alternative embodiments may involve implements 15 with greater degrees of freedom, such as those found on some motor graders 40, and those with fewer degrees of freedom, such as "pushbeam" style blades found on some crawlers 35 and implements 15 which may only be raised, lowered, and rotated around a vertical axis as found on some excavators and skidders.

The operator may command movement of the implement 15 from the operator station 20, which may be coupled to the machine or located remotely. In the case of the work vehicle 10, those commands are sent, including mechanically, hydraulically, and/or electrically, to a hydraulic control valve. The hydraulic control valve receives pressurized hydraulic fluid from a hydraulic pump, and selectively sends such pressurized hydraulic fluid to a system of hydraulic cylinders based on the operator's commands. The hydraulic cylinders, which in this case are double-acting, in the system are extended or retracted by the pressurized fluid and thereby actuate the implement 15. Alternatively, electronic actuators may be used.

With reference to FIG. 1, the illustrated work vehicle 10 is a crawler 35 for moving material. The crawler 35 includes tracks 45 including a left track 85 and a right track 90. As used herein, "left" and "right" refer to the left and right sides of the operator when the operator is sitting within the operator station 20 that is coupled to the work vehicle 10 and facing the implement 15.

Referring to FIG. 2, the illustrated work vehicle 10 is a motor grader 40 for spreading and leveling dirt, gravel, or other materials. The motor grader 40 includes wheels 50 including a plurality of left wheels 85 (right wheels not shown).

Figure 3:
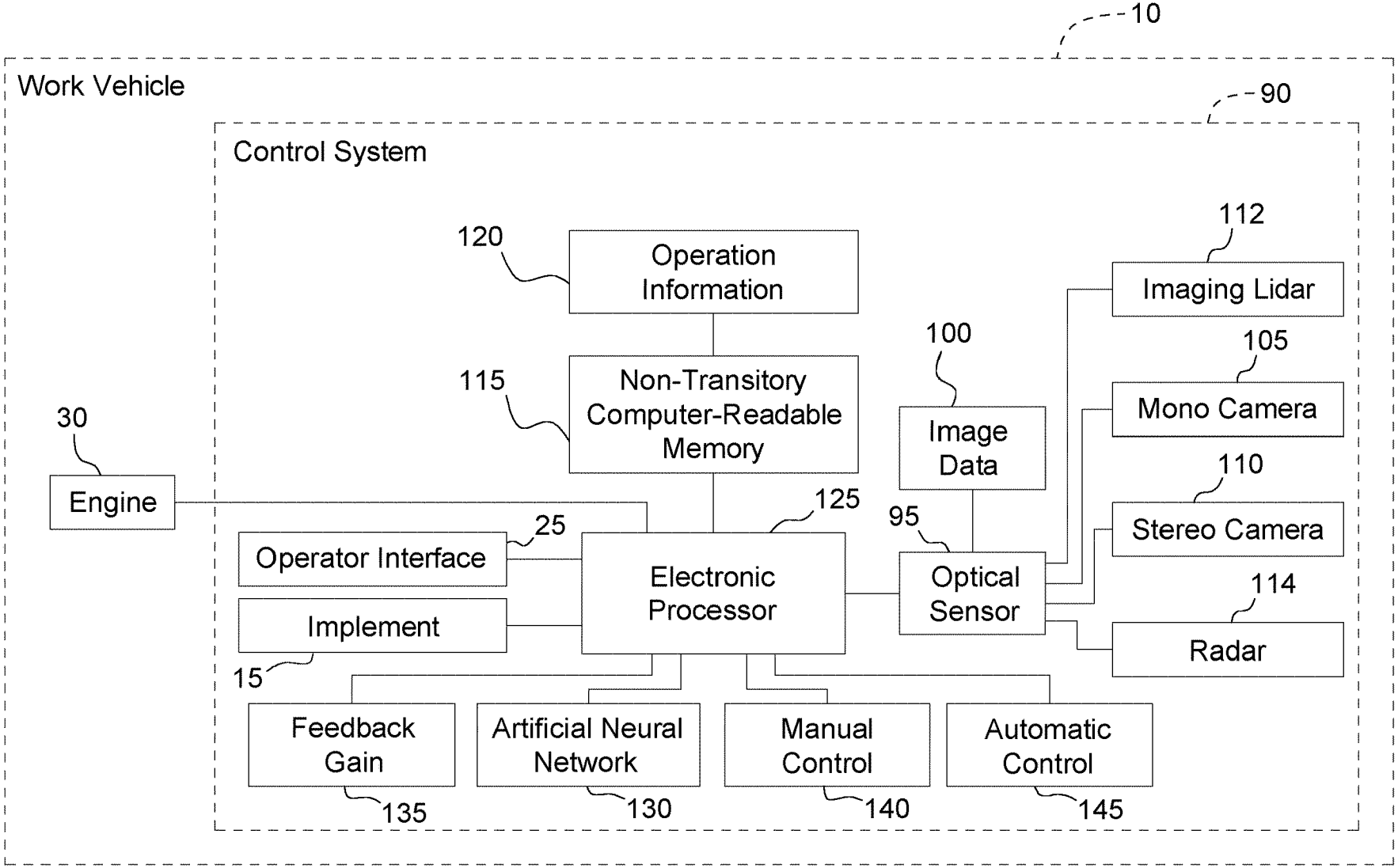
FIG. 3 is a block diagram of a ground engaging tool control system according to an embodiment.

With reference to FIG. 3, the work vehicle 10 has a control system 90. The control system 90 includes an optical sensor 95 coupled to the work vehicle 10. The optical sensor 95 may be configured to capture image data 100 that includes the implement 15. The optical sensor 95 may comprise either a mono camera 105 or a stereo camera 110. Alternatively, the optical sensor 95 may comprise imaging lidar 112 or radar 114. The stereo camera 110 may be configured to determine a distance from the implement 15 to the surface 65. The distance from the implement 15 to the surface 65 may be displayed on the operator interface 25.

The control system 90 also has a non-transitory computer-readable memory 115 that stores operation information 120. The non-transitory computer-readable memory 115 may comprise electronic memory, nonvolatile random-access memory, an optical storage device, a magnetic storage device, or another device for storing and accessing electronic data on any recordable, rewritable, or readable electronic, optical, or magnetic storage medium.

An electronic processor 125 is provided and configured to perform an operation by controllably adjusting a position of the implement 15 relative to the work vehicle 10. The electronic processor 125 may be arranged locally as part of the work vehicle 10 or remotely at a remote processing center (not shown). In various embodiments, the electronic processor 125 may comprise a microprocessor, a microcontroller, a central processing unit, a programmable logic array, a programmable logic controller, other suitable programmable circuitry that is adapted to perform data processing and/or system control operations.

The electronic processor 125 is configured to receive image data 100 captured by the optical sensor 95 and apply an algorithm of an artificial neural network 130 to identify whether the implement 15 is in contact with the surface 65, and/or how far from the surface, based on the image data 100 from the optical sensor 95. The artificial neural network 130 is trained to receive the image data 100 as input and to produce as the output an indication of whether the implement 15 is in contact with the surface 65 and/or how far from the surface. The electronic processor 125 accesses the operation information 120 corresponding to whether the implement 15 is in contact with the surface 65 from the non-transitory computer-readable memory 115 and automatically adjusts an operation of the work vehicle 10 based on the accessed operation information 120. The adjustment may include adjusting a position of the implement 15 relative to the work vehicle 10. The adjustment may include changing a feedback gain 135. The adjustment may include transitioning the control of the work vehicle 10 between a manual control 140 and an automatic control 145. During a snow plowing operation, the adjustment may include turning off a pressure control or adjusting pressure when the implement 15 is above or on the surface 65.

Additionally, the electronic processor 125 may predict when the implement 15 may be at or near the surface 65 and preemptively increase the speed of the engine 30. Alternatively, when the implement 15 is above the surface 65, the electronic processor 125 may decrease the speed of the engine 30.

Figure 4:
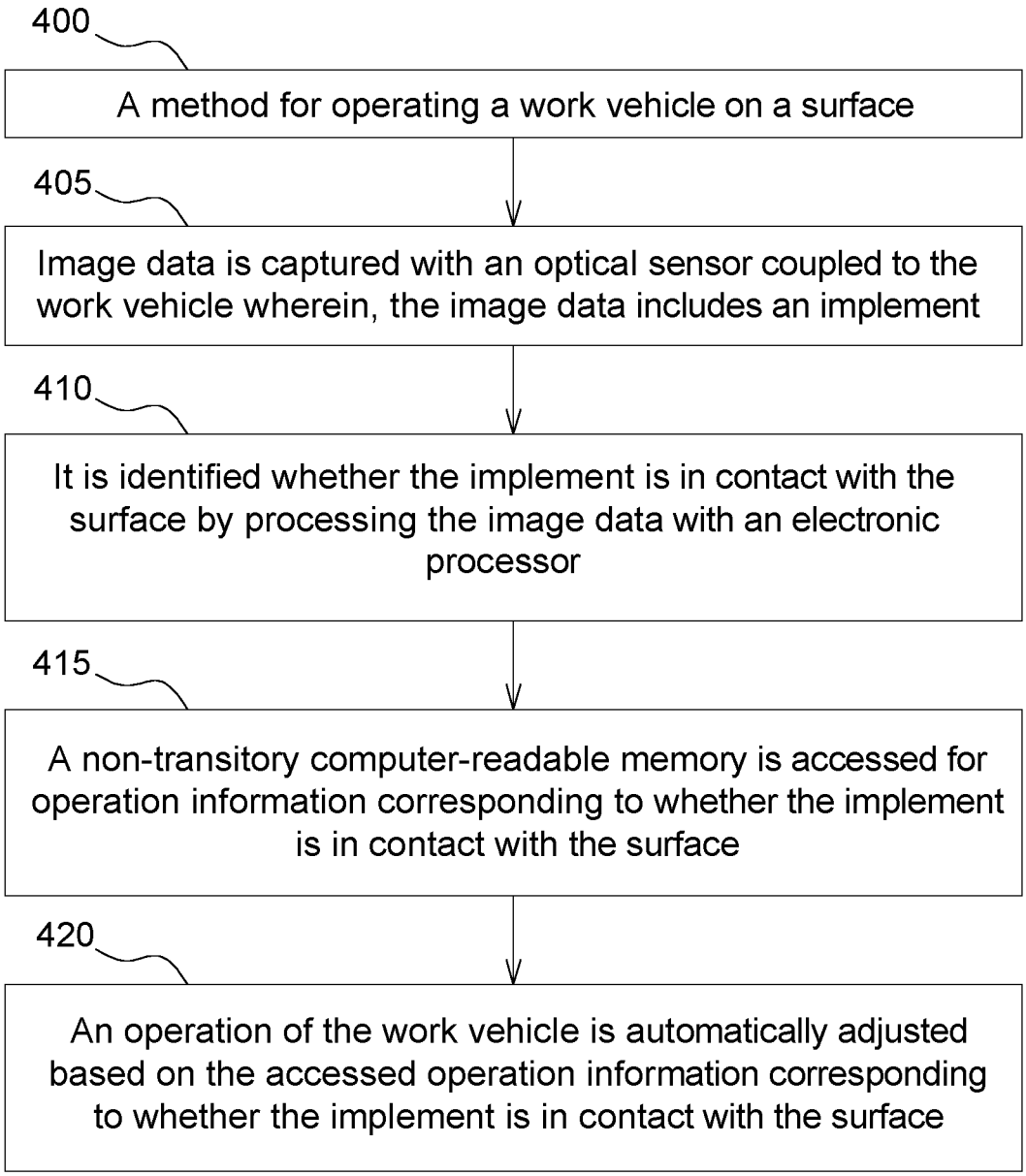
FIG. 4 is a flow diagram of a method for operating a work vehicle on a surface.

Referring now to FIG. 4, a flow diagram of a method 400 for operating a work vehicle on a surface 65 is shown. At 405, image data 100 is captured with an optical sensor 95 coupled to the work vehicle 10 wherein, the image data 100 includes an implement 15. At 410, it is identified whether the implement 15 is in contact with the surface 65 by processing the image data 100 with an electronic processor 125. At 415, a non-transitory computer-readable memory 115 is accessed for operation information 120 corresponding to whether the implement 15 is in contact with the surface 65 and at 420, an operation of the work vehicle 10 is automatically adjusted based on the accessed operation information 120 corresponding to whether the implement 15 is in contact with the surface 65.

What is claimed is:

1. A method of operating a work vehicle on a surface, the method comprising:

capturing image data with an optical sensor coupled to the work vehicle wherein, the image data includes an implement;

identifying whether the implement is in contact with the surface by processing the image data with an electronic processor;

accessing, from a non-transitory computer-readable memory, operation information corresponding to whether the implement is in contact with the surface; and automatically adjusting an operation of the work vehicle based on the accessed operation information corresponding to whether the implement is in contact with the surface;

wherein, when the implement may be at or near the surface increasing a speed of an engine and when the implement is above the surface decreasing the speed of the engine.

2. The method of claim 1, wherein the adjusting the operation of the work vehicle comprises changing a feedback gain.

3. The method of claim 1, wherein the adjusting the operation of the work vehicle comprises transitioning the control of the work vehicle between a manual control and an automatic control.

4. The method of claim 1, wherein the optical sensor comprises a stereo camera.

5. The method of claim 4, wherein the stereo camera is configured to determine a distance from the implement to the surface.

6. The method of claim 5, wherein the distance from the implement to the surface is displayed on an operator interface.

7. The method of claim 5, wherein automatically adjusting the operation of the work vehicle is based on the operation information corresponding to whether the implement is in contact with the surface and the distance from the implement to the surface.

8. The method of claim 1, wherein the optical sensor comprises a mono camera.

9. The method of claim 1, wherein identifying whether the implement is in contact with the surface by processing the image data comprises:

providing the image data as an input to an artificial neural network, wherein the artificial neural network is trained to receive as the input, image data including at least a portion of an implement, and to produce as an output, an identification of whether the implement is in contact with the surface; and receiving an indication of the identification of whether the implement is in contact with the surface as the output of the artificial neural network.

10. A control system for a work vehicle that operates on a surface, the control system comprising:

an optical sensor coupled to the work vehicle, the optical sensor configured to capture image data that includes an implement;

a non-transitory computer-readable memory storing operation information; and an electronic processor configured to:

perform an operation by controllably adjusting a position of the implement relative to the work vehicle, receive image data captured by the optical sensor, apply an artificial neural network to identify whether the implement is in contact with the surface based on the image data from the optical sensor, wherein the artificial neural network is trained to receive the image data as input and to produce as the output an indication of whether the implement is in contact with the surface, access, from the non-transitory computer-readable memory, the operation information corresponding to whether the implement is in contact with the surface, and automatically adjust an operation of the work vehicle based on the accessed operation information corresponding to whether the implement is in contact with the surface;

wherein, when the implement may be at or near the surface increasing a speed of an engine and when the implement is above the surface decreasing the speed of the engine.

11. The control system of claim 10, wherein adjusting the operation of the work vehicle comprises changing a feedback gain.

12. The control system of claim 10, wherein the adjusting the operation of the work vehicle comprises transitioning the control of the work vehicle between a manual control and an automatic control.

13. The control system of claim 10, wherein the optical sensor comprises a stereo camera.

14. The control system of claim 13, wherein the stereo camera is configured to determine a distance from the implement to the surface.

15. The control system of claim 14, wherein the distance from the implement to the surface is displayed on an operator interface.

16. The control system of claim 14, wherein automatically adjusting the operation of the work vehicle is based on the operation information corresponding to whether the implement is in contact with the surface and the distance from the implement to the surface.

17. The control system of claim 10, wherein the optical sensor comprises a mono camera.

18. The control system of claim 10, wherein identifying whether the implement is in contact with the surface by processing the image data comprises:

providing the image data as an input to an artificial neural network, wherein the artificial neural network is trained to receive as the input, image data including at least a portion of an implement, and to produce as an output, an identification of whether the implement is in contact with the surface; and receiving an indication of the identification of whether the implement is in contact with the surface as the output of the artificial neural network.

19. A work vehicle that operates on a surface, the work vehicle comprising:

an implement;

an optical sensor coupled to the work vehicle, the optical sensor configured to capture image data that includes the implement;

a non-transitory computer-readable memory storing operation information; and an electronic processor configured to:

perform an operation by controllably adjusting a position of the implement relative to the work vehicle, receive image data captured by the optical sensor, apply an artificial neural network to identify whether the implement is in contact with the surface based on the image data from the optical sensor, wherein the artificial neural network is trained to receive the image data as input and to produce as the output an indication of whether the implement is in contact with the surface, access, from the non-transitory computer-readable memory, the operation information corresponding to whether the implement is in contact with the surface, and automatically adjust an operation of the work vehicle based on the accessed operation information corresponding to whether the implement is in contact with the surface;

wherein, when the implement may be at or near the surface increasing a speed of an engine and when the implement is above the surface decreasing the speed of the engine.

20. The work vehicle of claim 19, wherein the optical sensor comprises at least one of a mono camera or a stereo camera.

* * * * *